United States Patent [19]

Chao et al.

[11] 3,995,152

[45] Nov. 30, 1976

[54] ELECTRICAL LIGHTING STRUCTURE BUILT-IN A MOLDED PLASTIC CORD OR CABLE

[76] Inventors: Albert Chao, 407 Glendale Road, Northvale, N.J. 07647; Frank Fantigrossi, 3017 Acorn Ave., Medford, N.Y. 11763

[22] Filed: Apr. 3, 1975

[21] Appl. No.: 564,705

[52] U.S. Cl. ..... 240/10 R; 240/10 T; 174/117 R; 174/117 A

[51] Int. Cl.[2] ..... F21P 1/02; H01B 11/02

[58] Field of Search ..... 240/9 R, 10 R, 10 T; 174/117 R, 117 F, 117 FF, 117 A; 40/130 D, 130 N, 130 R

[56] References Cited

UNITED STATES PATENTS

| | | | |
|---|---|---|---|
| 2,701,929 | 2/1955 | Lemelson | 240/10 A X |
| 3,029,303 | 4/1962 | Severino | 174/117 A X |
| 3,214,579 | 10/1965 | Pacini | 240/9 R X |
| 3,641,333 | 2/1972 | Gendron | 240/6.4 W |
| 3,755,663 | 8/1973 | George, Jr. | 240/10 R |
| 3,836,759 | 9/1974 | Silverman | 240/10 T X |
| 3,894,225 | 7/1975 | Chao | 240/10 R X |

*Primary Examiner*—George H. Miller, Jr.

[57] ABSTRACT

A lighting structure adaptable for many uses the assembly consisting of a plurality of baseless light bulbs wired in a parallel electrical circuit. The circuit and lamps being fully encapsulated in a molded, flexible (or non-flexible), transparent casing such as a plastic or plasticized resin material. This molded cord containing the lighting structure can be made to also contain additional wires for extraneous purposes, or a channel running the length to transport liquids or gases.

5 Claims, 10 Drawing Figures

FIG. 1
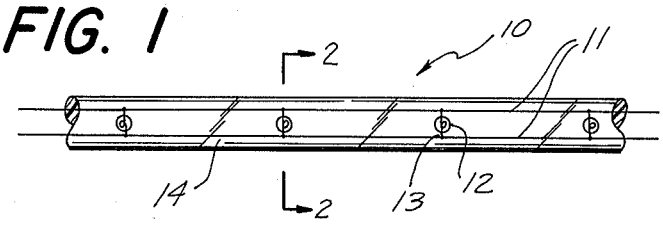
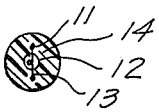
FIG. 2
FIG. 3
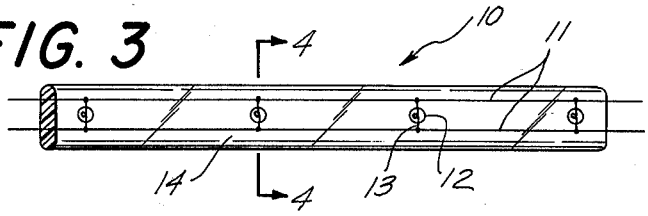
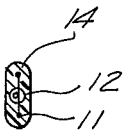
FIG. 4
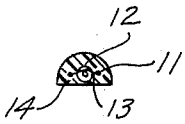
FIG. 5A
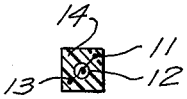
FIG. 5B
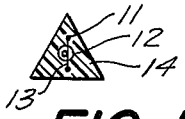
FIG. 5C
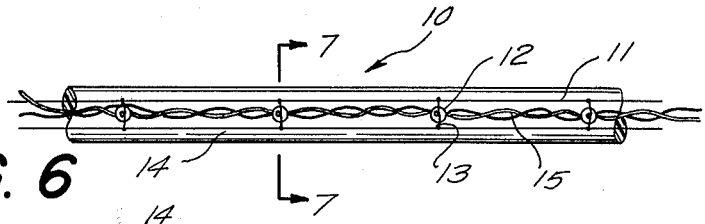
FIG. 6
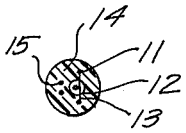
FIG. 7
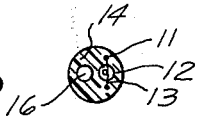
FIG. 8
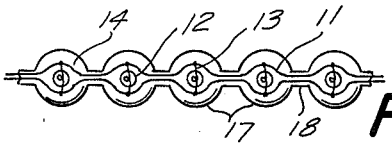
FIG. 9
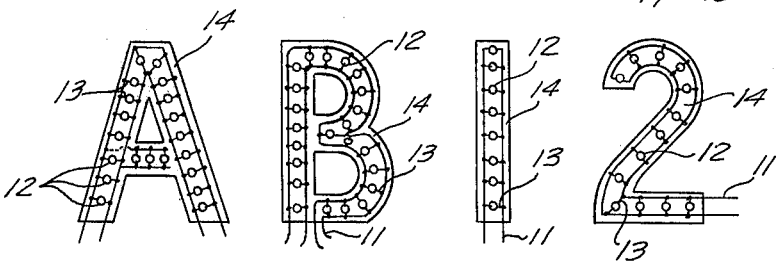
FIG. 10

ELECTRICAL LIGHTING STRUCTURE BUILT-IN A MOLDED PLASTIC CORD OR CABLE

This invention relates to electrically illuminated displays and lighting structure.

A principle object of this invention is to provide a series of lights built-in to a molded, dielectric, plastic, transparent, and flexible (or non-flexible) cord which can be used as a decorative device, or warning device, that is easy and economical to manufacture.

Another object of this invention is to provide a device which can be cut to any length as desired by the user.

Yet another object of this invention is to provide a device which can be used in display signs as a replacement for the expensive, and more hazardous neon signs presently used.

Still another object is to provide a device which can be used with low voltage and low current or using D.C. power source to reduce or eliminate the safety problems. For example when used as displays on Christmas trees it will eliminate the fire problem; it greatly reduces the shock hazard to personnel. In addition the use of low voltage is more economical to operate than standard A.C. voltage.

Further objects of this invention will become evident as the description proceeds.

To the accomplishment of the above and related objects this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of this invention showing the two wires and the light bulbs embedded in the transparent cord.

FIG. 2 is a cross section along line 2—2.

FIG. 3 is a perspective view of another configuration of the invention.

FIG. 4 is a cross section along line 4—4.

FIGS. 5A, 5B, and 5C illustrate examples of various cross sections in which the cord may be molded.

FIG. 6 illustrates an example of this invention with an extraneous pair of twisted wires embedded in the core.

FIG. 7 is a cross section along line 7—7.

FIG. 8 is a cross section of another variation of this invention where a channel is provided in the cord for the transportation of a liquid or gas.

FIG. 9 illustrates the various configurations the lights may be molded in.

FIG. 10 illustrates examples of various designs of the device.

Referring now to the drawings in detail, the reference numeral 10 represents the lamp-cord assembly according to the present invention wherein there is an electric circuit 11 consisting of a plurality of baseless light bulbs 12 connected in parallel by attaching the legs of the bulbs 13 to the circuit wires 11. The circuit 11 together with the lights 12 are encased in molded plastic 14 forming the circuit insulation as well as becoming the cord. This molded plastic cord 14 is made of plasticized polyvinyl chloride or other synthetic resin material, and is transparent, and flexible (or non-flexible) as well as electrically insulating. The light bulbs 12 are connected in parallel in the circuit 11 so that the cord 14 may be cut at any length desired or any bulb may burn out without affecting the operation of the remaining bulbs.

FIGS. 1 and 2 represent the invention 10 with a cord 14 molded into a circular configuration. In such a configuration it is well suited for use as decorations on for example Christmas trees. The diameter of the cord 14 can be made to be any size desired.

This invention uses low voltage of about 6V DC which reduces shock hazards and fire problems, and adds to bulb life.

FIGS. 3 and 4 illustrate the cord 14 in another configuration. In this shape, relatively flat, one side of the cord 14 may be made with pressure sensitive adhesive for quick and easy application to any wall or surface where a decorative effect or warning is desired.

FIGS. 5A, 5B, and 5C illustrate examples of various cross sections, the cord 14 can be molded into. Also in these one or more sides can be made with adhesive for easy application to any surface.

FIGS. 6 and 7 illustrate the invention in use with, in addition to the electrical circuit 11 and lights 12 encased in the molded cord 14, there is a pair of wires 15. These wires may be for another extraneous purpose such as would be case if a telephone cord employed this invention.

FIG. 8 illustrates a cross section of the cord 14, the light bulb 12 and legs 13, connected to the electrical circuit wires 11, as well as a vacant channel 16. This channel 16 runs the length of the cord 14 and could be used to transport liquids or gases. This feature might be used for example, in fountains where this invention may be functional (transporting of liquid), as well as decorative.

FIG. 9 depicts the invention in a novel form simulating a series of beads 17 connected by a thin section of smaller diameter 18 between beads 17 adding to the decorative effect and increasing flexibility. Located within each bead 17 is a single light bulb 12. As throughout this invention the cord 14, in this case molded into the shape of beads, is a solid, flexible, transparent, dielectric material.

The distance between light bulbs 12 is variable and how it will be manufactured will depend on its uses. The cord 14 can be made with no lights for several feet at one end to basically act as an extension cord. The lights 12 can be made to be right next to each other to several inches or feet as desired.

FIGS. 1 through 9 refer to the invention in the cord or cable configuration, however it will be noted that any shape, design, a configuration may be made wherein the electric circuit 11 and light bulbs 12, are encased in a molded covering of plasticized polyvinyl chloride or other synthethic resin. Examples of this are seen in FIG. 10 wherein the designs are letters and numerals. Such configurations allow this invention to be used in display signs, warning signs etc. This represents a safer, more economical replacement for neon signs presently used. In addition many other configurations and designs are possible for many other decorative or functional uses not specifically mentioned.

The lamps 12 in any configuration may be any shape as necessary, and may be provided in multiple colors or in the same color in a cord 14.

It is understood that the device 10 may be made with adhesive on one or more sides for easy application to a surface. Also the device 10 may be operated either by a battery pack, or by household current using a suitable transformer. The molded plastic forming the cord or encasement 14 although normally clear transparent, may be transparent and tinted to provide another effect.

Thus a useful Electrical Lighting Structure Built in A Molded Plastic Cord or Cable is provided.

While certain novel features of this invention have been shown and described and are pointed out in the annexed claims, it will be understood that various omissions, substitutions and changes in the form and details of the device illustrated and in its operation can be made by those skilled in the art without departing from the spirit of the invention.

We claim as our invention:

1. An electrical lighting structure comprised of a pair of bare wires with a plurality of baseless light bulbs connected in parallel across the pair of bare wires; said combination being fully encased in a molded plastic or resin material, inherently forming the cord as well as the wiring insulation.

2. The combination as set forth in claim 1 whereby the molded plastic cord is transparent and flexible (or non-flexible).

3. The combination as set forth in claim 2 whereby a suitable adhesive is applied to at least one outer side of said structure for securement to any of various surfaces, such as wood, glass, metal, or the like.

4. The combination as set forth in claim 3 whereby the device may be constructed in any configuration or design such as numerals, or letters.

5. The combination as set forth in claim 4 wherein a channel running longitudinally along the length of the structure is contained within the molded plastic cord, is insulated from the electrical circuit, and can be used to transport liquids or gases for extraneous purposes.

* * * * *